US009987181B2

(12) United States Patent
Hochman et al.

(10) Patent No.: US 9,987,181 B2
(45) Date of Patent: Jun. 5, 2018

(54) PORTABLE ELEVATING SEAT

(71) Applicants: Leon Hochman, West Bloomfield, MI (US); Nancy Valvona, West Bloomfield, MI (US); Stephen Nicolato, West Bloomfield, MI (US)

(72) Inventors: Leon Hochman, West Bloomfield, MI (US); Nancy Valvona, West Bloomfield, MI (US); Stephen Nicolato, West Bloomfield, MI (US)

( * ) Notice: Subject to any disclaimer, the term of this patent is extended or adjusted under 35 U.S.C. 154(b) by 0 days. days.

(21) Appl. No.: 15/603,562

(22) Filed: May 24, 2017

(65) Prior Publication Data

US 2017/0340496 A1 Nov. 30, 2017

Related U.S. Application Data

(60) Provisional application No. 62/340,607, filed on May 24, 2016.

(51) Int. Cl.

| | |
|---|---|
| ***A61G 5/14*** | (2006.01) |
| ***A47C 3/20*** | (2006.01) |
| ***A47C 7/02*** | (2006.01) |
| ***A47C 3/40*** | (2006.01) |

(52) U.S. Cl.

CPC ..... *A61G 5/14* (2013.01); *A47C 3/20* (2013.01); *A47C 3/40* (2013.01); *A47C 7/02* (2013.01)

(58) Field of Classification Search

CPC .... A61G 5/14; A47C 3/40; A47C 3/20; A47C 7/02

USPC ..... 297/339, 338, DIG. 10, 344.18, 423.45, 297/DIG. 8, 337, 344.19

See application file for complete search history.

(56) References Cited

U.S. PATENT DOCUMENTS

| | | | | |
|---|---|---|---|---|
| 3,736,897 | A * | 6/1973 | Krutz | B63B 29/04 114/363 |
| 4,013,316 | A | 3/1977 | Cropper | |
| 4,234,989 | A * | 11/1980 | Pearcy | B63B 29/04 114/363 |
| 5,806,110 | A * | 9/1998 | Kunz | A47K 3/122 297/452.41 |
| 6,113,188 | A | 9/2000 | Stewart et al. | |
| 6,317,909 | B1 | 11/2001 | Blum | |
| 7,594,698 | B1 | 9/2009 | Palmer | |
| 8,037,560 | B2 * | 10/2011 | Goldner | A47C 7/021 297/DIG. 10 |

(Continued)

*Primary Examiner* — Milton Nelson, Jr.

(74) *Attorney, Agent, or Firm* — The Weintraub Group, PLC

(57) ABSTRACT

A portable elevating seat for assisting a person into and out of a seating includes a central telescoping unit with a seating member mounted thereon. Preferably, the seat further includes a pneumatic pump and at least one pressure relief valve in fluid communication with the central telescoping unit for providing a flow of air into and out of the central telescoping unit. The seat includes a power source being in electronic communication with the pneumatic pump. The seat further includes a control unit in electronic communication with the pneumatic pump and the power source for actuating the seat between a raised and a lowered position. As the pneumatic pump is actuated by the control unit, air flows into the central telescoping unit, thus extending the central telescoping unit and lifting the seating member to a desired height.

14 Claims, 4 Drawing Sheets

(56) References Cited

U.S. PATENT DOCUMENTS

| | | | |
|---|---|---|---|
| 8,267,474 | B2 | 9/2012 | Fetisoff |
| 2007/0028388 | A1 | 2/2007 | Fletcher |
| 2010/0117039 | A1 | 5/2010 | Perrett et al. |
| 2014/0232156 | A1 | 8/2014 | Mills |

* cited by examiner

PORTABLE ELEVATING SEAT

CROSS-REFERENCE TO RELATED APPLICATION

This application is a completion application which claims the priority benefit of U.S. Provisional Patent Application Ser. No. 62/340,607, filed May 24, 2016, for "Portable Elevating Seat," the entire disclosure of which, including the drawing, is hereby incorporated by reference.

BACKGROUND OF THE INVENTION

1. Field of the Invention

The present invention pertains to a portable seat. More particularly, the present invention pertains to a portable seat having an adjustable height. Even more particularly, the present invention pertains to a pneumatic-powered, portable seat.

2. Description of Related Art

On average, more than one in every three persons over the age of 65 fall each year and the number only rises with age. As a consequence of those falls, more than 1.6 million older adults are admitted into the emergency room each year with fall-related injuries, typically resulting in fractures, loss of independence, and even death.

Many people, especially the elderly or those with a variety of chronic illnesses such as arthritis and obesity, find it to be a constant struggle to move from a seated position to a standing position or vice versa. Getting into a seated position from a standing position can result in the person losing their balance, pushing the chair out from behind him, and falling to the ground. These falls may result in a fracture to the person's pelvis, spine, arm, hand, ankle, and, most commonly, hip. While many of those who experience hip fractures can return to their normal activity after treatment and rehabilitation, a number of those injured will require assisted living and long-term care for the remainder of their lives.

To prevent falls such as these while getting into and out of chairs or wheelchairs, the prior art teaches many devices that attempt to assist in such instances. One such device is disclosed in U.S. Pat. No. 7,549,698 to Palmer, which teaches a pneumatic-powered, portable seat for a wheelchair that allows a person to elevate oneself off of the chair or slowly ease oneself onto the chair. At least one pneumatically inflatable bag connected to a battery-powered air pump is sandwiched between a top surface and a bottom surface. While this device is adaptable for any wheelchair or electric scooter, it requires that the battery supply be secured to the back of the chair. Therefore, the battery supply is not integrated into the device, itself, but a separate component. Further, as the bag inflates with air, the reference fails to teach a pressure relief valve for equalizing pressure in the bag and support means to prevent the bag from rocking back and forth or from side to side. Without such support, an elevating seat may add even more instability to the person getting up from the chair or attempting to be seated.

Similarly, in U.S. Pat. No. 6,113,118 to Stewart there is disclosed a portable seat assisting device disposed atop a chair. The seat includes a battery-powered air compressor that inflates an accordion-style air chamber. As the air chamber inflates, the device extends vertically, thereby lifting a top seat member from a bottom seat member. As the top seat member is raised, it can either assist the person in slowly sitting down in the chair or gently lift the person off of the chair in order to reduce the struggle in standing under the person's own strength. While this reference teaches an integrated battery supply and support means on the sides of the device, the support means is merely a pair of scissor-braces pivotally connecting to the top and bottom seat members. This provides only minimal support when there is substantial weight atop the seat. Further, the device still fails to include a pressure relief valve in order to sustain a safe and appropriate pressure within the device during use.

In published PCT application WO 88/07848 to Hoffmann, there is taught a device for raising and lowering infirm or disabled persons. The device includes a hydraulic, telescopic lifting mechanism for lifting and lowering a person into a bath tub. The device omits any electronic circuitry providing user controls, nor a pressure relief valve to maintain a safe pressure within the device. The reference also teaches that the device may be portable between chairs, but, preferably, the device is stationary and temporarily mounted to the floor proximate the bath tub.

Additionally, while each of the devices disclosed in the above references may be suitable for the uses and problems they intend to solve, there is an ongoing need for improvements in a portable elevating seat that provides optimal stability to a person while in use.

It is to this to which the present invention is directed.

SUMMARY OF THE INVENTION

The present invention provides a portable, pneumatic, user-controlled elevating seat that can be used with any number of seats such as those found on chairs, wheelchairs, and electric scooters, and the like, wherein the seat is large enough to accommodate the elevating seat.

The portable elevating seat comprises: (a) a platform; (b) a central telescoping unit mounted atop the platform, the central telescoping unit including a seating member mounted thereon, the central telescoping unit having an enclosed interior between the platform and the seating member; (c) means for raising and lowering the central telescoping unit; (d) a power source in electronic communication with the means for raising and lowering; and (e) a control unit for actuating the central telescoping unit, the control unit being in electronic communication with the means for raising and lowering and the power source.

Preferably, the means for raising and lowering the central telescoping unit comprises a pneumatic pump for injecting air into the interior of the central telescoping unit. When a pneumatic pump is employed, the seat further comprises a first pressure relief valve in fluid communication with the central telescoping unit for lowering the pressure therein when necessary.

In a preferred embodiment, the central telescoping unit, itself, comprises a plurality of frames, each being dimensionally smaller than an adjacent outer frame to enable nesting within one another. The plurality of frames defines the enclosed interior between the platform and the seating member. As air is supplied into the central telescoping unit, upward pressure is applied to the seating member, which causes the plurality of frames to sequentially raise. As each frame rises, adjacent frames are engaged and raised as well in order to adjust the height of the seating member.

The portable elevating seat may be readily positionable atop a seating, such as a chair, bench, bed, or the like, in order to assist a person in gradually sitting down or rising up to a standing position. In doing so, the seat may be freely positioned or may include attachment means for removably securing the seat atop the seating.

For a better understanding of the present invention, reference is made to the accompanying drawing and detailed description. In the drawing, like reference characters refer to like parts through the several views, in which:

DETAILED DESCRIPTION OF THE INVENTION

Figure 1:
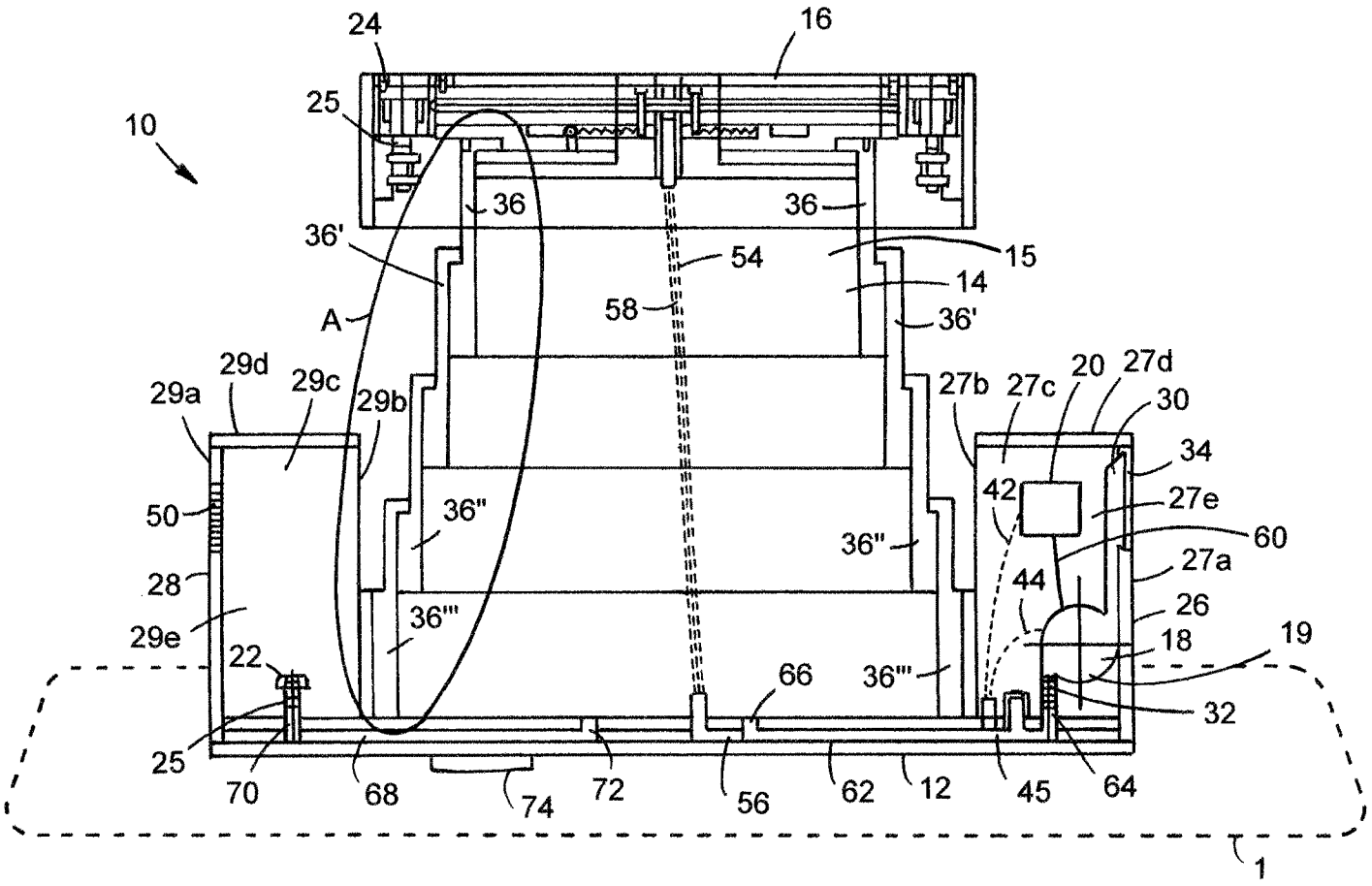
FIG. 1 is a front, cross-sectional view of a portable elevating seat in the lifting position in accordance with the present invention.
Figure 2:
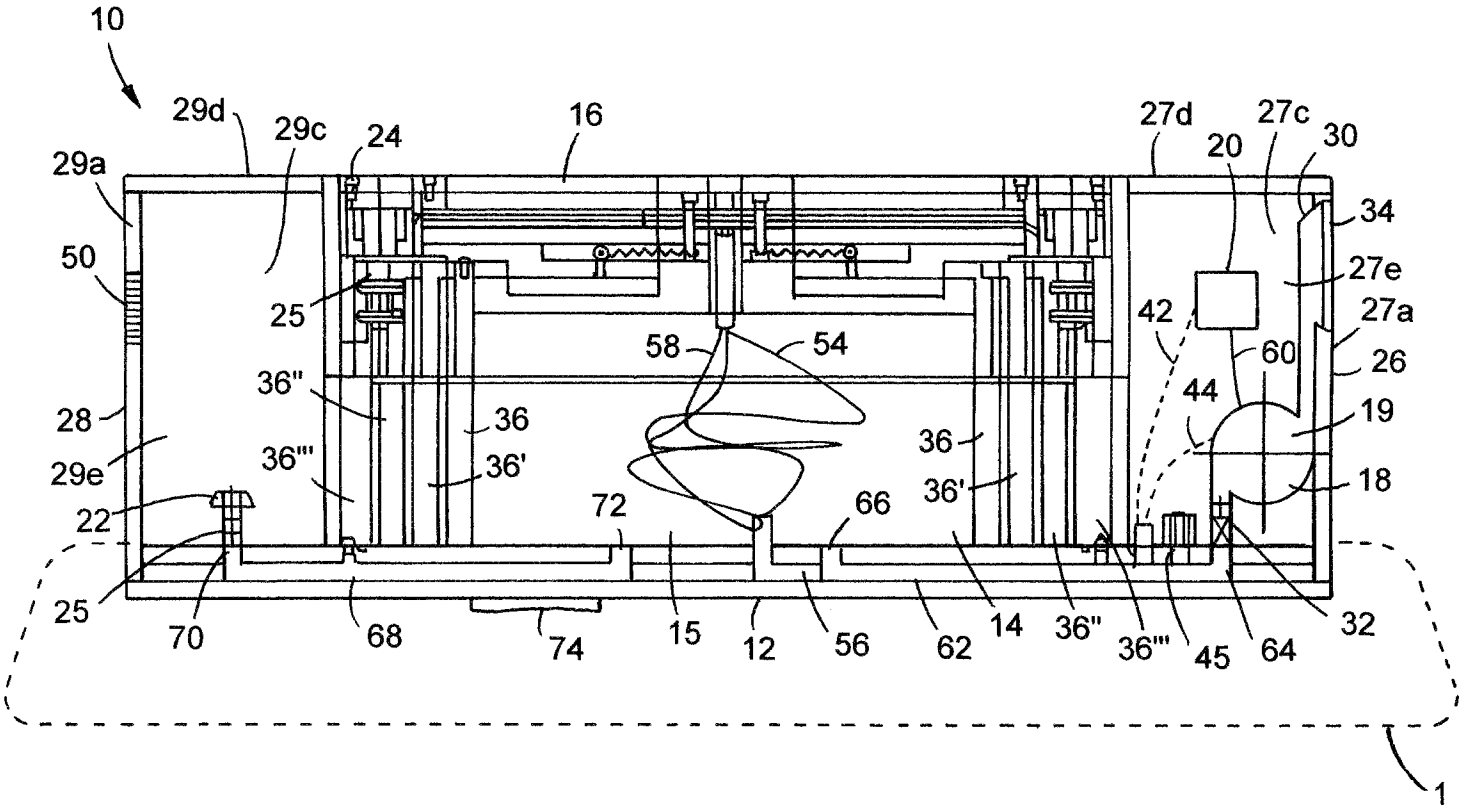
FIG. 2 is a front, cross-sectional view of the portable elevating seat of FIG. 1 in a seated position.

Now, and in accordance with the present invention and with reference to FIGS. 1 and 2 of the drawing and as noted above, there is provided a portable elevating seat denoted at 10, generally, comprising:

(a) a platform 12; (b) a central telescoping unit 14 mounted atop the platform 12, the central telescoping unit 14 including a seating member 16 mounted thereon, the central telescoping unit 14 having an enclosed interior 15; (c) means 18 for raising and lowering the central telescoping unit 14; (d) a power source 20 in electronic communication with the means 18 for raising and lowering; and (e) a control unit 24 for actuating the central telescoping unit 14, the control unit 24 in electronic communication with the means 18 for raising and lowering and the power source 20.

While it is to be understood that the means 18 and the power source 20 may be located in any suitable location on the seat 10, preferably, the means 18 and the power source 20 are contained within a first enclosure 26 in order to isolate these components.

As shown in FIGS. 1 and 2, the first enclosure 26 is mounted atop the platform 12 adjacent the central telescoping unit 14. The first enclosure 26 includes a pair of sidewalls 27*a*, 27*b*, a front wall (not shown), and a back wall 27*c* extending upwardly from the platform 12. A top wall 27*d* interconnects the pair of sidewalls 27*a*, 27*b*, the front wall, and the back wall 27*c* to define an enclosed interior 27*e* within the first enclosure 26.

The means 18 for raising and lowering the central telescoping unit 14 may comprise any suitable apparatus such as a gear motorized mechanical arrangement, a pneumatic actuator, and the like. Preferably, the means 18 comprises a pneumatic pump 19 for injecting air into the interior 15 of the central telescoping unit 14.

As shown in FIGS. 1 and 2, the pneumatic pump 19 is in fluid communication with the central telescoping unit 14 and is disposed within the enclosed interior 27*e* of the first enclosure 26. The pneumatic pump 19 includes an inlet 30 and an outlet 32. The pneumatic pump 19 comprises any well-known, commercially available, bi-directional pneumatic pump allowing air to flow in either direction.

The inlet 30 of the pneumatic pump 19 is, preferably, secured to the sidewall 27*a* of the first enclosure 26 opposite the central telescoping unit 14. The inlet 30 is sealed at 34 and is flush with the sidewall 27*a* in order to facilitate the drawing of air from outside of the first enclosure 26 and into the pneumatic pump 19. The outlet 32 provides an exit point for air to exit the pneumatic pump 19 and the first enclosure 26. In use, air flows from the pneumatic pump 19 into the central telescoping unit 14 via a first conduit 62.

The first conduit 62 is preferably disposed within the platform 12 and includes a first end 64 and a second end 66. The first end 64 of the first conduit 62 is secured to the outlet 32 of the pneumatic pump 19 and terminates at the second end 66 within the interior 15 of the central telescoping unit 14.

A power source 20 powers the pneumatic pump 19 and is in electronic communication therewith via a first wire 60. The power source 20 may be either an AC or DC battery. Preferably, the power source 20 is a rechargeable DC battery disposed on or within the seat 10. This allows for the seat 10 to remain portable and not restrict its movement by requiring the seat 10 to remain plugged into an external power source.

As shown in FIGS. 1-4, the central telescoping unit 14 comprises a plurality of frames 36, 36', 36", 36''' each being identical in structure except that the width or diameter of each frame is slightly smaller than an adjacent outer frame to enable nesting within one another. The frames cooperatively form the front, the back, and the sides of the central telescoping unit 14, thereby defining the enclosed interior 15 for pressure to build within as air accumulates. The frames may comprise any suitable geometry such as a plurality of open-ended cylinders or rectangles. Furthermore, each frame may be formed from any suitable material which provides a strong support, such as steel, aluminum, a rigid plastic, and the like, but must not be overly heavy to offset the buildup of air pressure within the enclosed interior 15.

Figure 3:
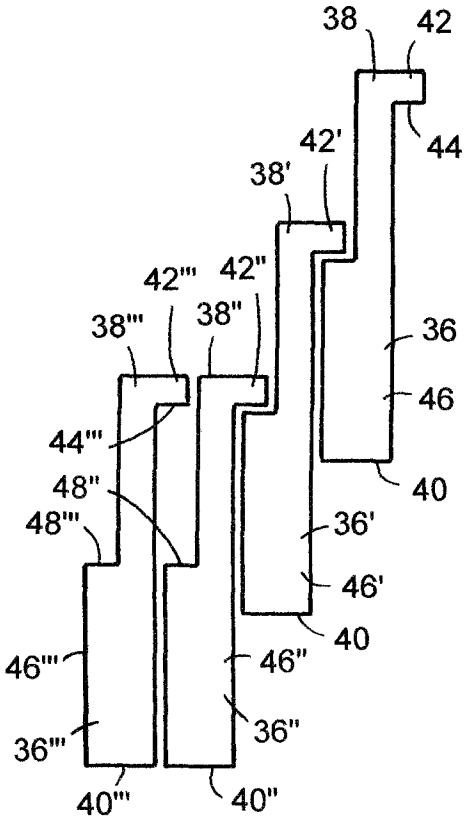
FIG. 3 is a close-up detailed view taken along circle A in FIG. 1 of a plurality of frames in a semi-extended position in accordance with the present invention.
Figure 4:
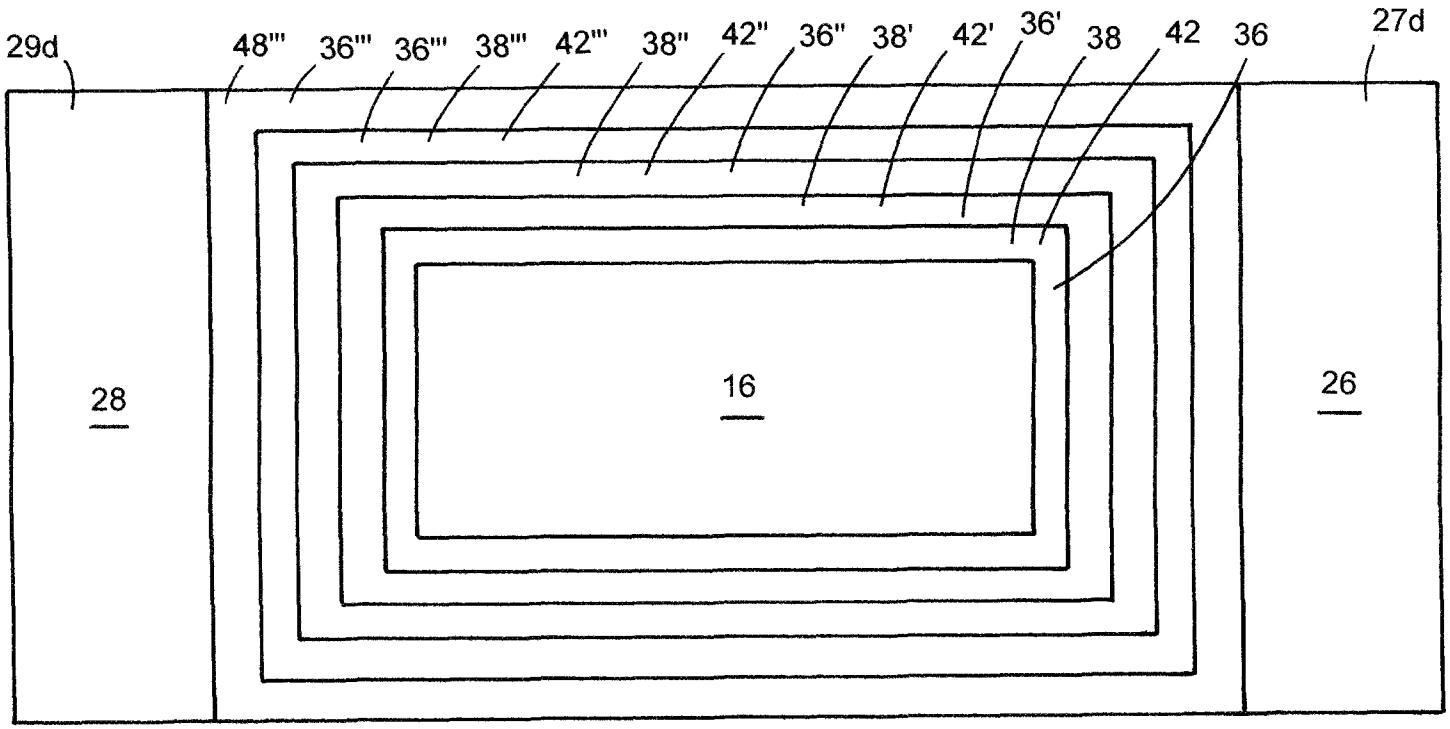
FIG. 4 is a top view of the portable elevating seat hereof.

With more particularity and with reference now to FIGS. 3 and 4, the frames 36, 36', 36", 36''', as shown, sequentially raise as each frame mates with and engages an adjacent frame.

As noted above, each of the frames 36, 36', 36", 36''' has an identical structure and, therefore, only the innermost frame 36 will be discussed in detail hereinbelow.

The frame 36 includes an upper end 38 and a lower end 40. The upper end 38 includes a lip 42 extending inwardly toward the central telescoping unit 14. The lip 42 has a lower lip surface 44. The lower end 40 of the frame 36 extends outwardly from the central telescoping unit 14 and forms a ledge 46. The ledge 46 includes an upper ledge surface 48 for mating with a lower lip surface 44' of an adjacent frame 36'. The lower end 40''' of the outermost frame 36''' is mounted atop the platform 12 and creates an air tight seal between the platform 12 and the central telescoping unit 14.

The seating member 16, such as a cushion or pad, is mounted atop the central telescoping unit 14 to the upper end 38 of the innermost frame 36. Thus, as the central telescoping unit 14 fills with air, the air applies upward pressure to the seating member 16. In doing so, the seating member 16 urges the innermost frame 36 upwardly.

As the innermost frame 36 extends upwardly along with the seating member 16, the ledge 46 thereof engages the lip 42' of an adjacent frame 36' and urges the adjacent frame 36' upwardly as well. This process of each frame engaging an adjacent frame, i.e. frame 36' engaging frame 36" and frame 36" engaging frame 36''', continues in an asynchronous or synchronous fashion until each one of the frames is completely extended or the pneumatic pump 19 is disabled.

Conversely, as air is released from the central telescoping unit 14 and the pressure therein is decreased, the frames simultaneously retract into their lowered positions.

As shown in FIG. 2, once the frames completely retract, the lower ends 40, 40', 40", 40''' of frames 36, 36', 36", 36''', respectively, sit flush atop the platform 12 to provide additional support for the seating member 16.

It is to be understood that any number and sizes of frames 36 may be used. Where the central telescoping unit 14 comprises additional frames 36, or frames being dimensionally larger, the seating member 16 will be capable of rising to a higher elevation.

Referring again to FIGS. 1 and 2, with regards to operating the seat 10, the control unit 24 is mounted through any suitable means onto the seating member 16, preferably at a location that is easily accessible to the person while seated thereon. The control unit 24 includes an "UP" actuator, such as a push button, to activate the pneumatic pump 19 in a first direction in order to inflate the central telescoping unit 14 and a "DOWN" actuator, such as a push button, to activate the pneumatic pump 19 in a second direction to evacuate air out of the central telescoping unit 14. It is also preferred that the control unit 24 include a "POWER" actuator, such as a push button, and a low battery indicator. It should be noted that all reference to a "button" is understood to include any suitable control mechanism such as a switch, toggle, or the like.

The control unit 24, preferably, has its own power supply and is in electronic communication with the power source 20 via a second wire 54. The second wire 54 connects to the control unit 24 at a first end and connects to the power source 20 at a second end. When the "POWER" button on the control unit 24 is pressed, a signal is sent via the second wire 54 which connects the control unit 24 to the power source 20.

A third wire 58 connects to the control unit 24 at a first end and to the pneumatic pump 19 at a second end. When the "UP" or "DOWN" button is pressed, a signal is sent from the control unit 24 to the pneumatic pump 19. Preferably, each of the wires 54, 58, 60 extends through a third conduit 56 disposed within the platform 12 in order to protect the wires 54, 58, 60 from the other components.

Additionally, the control unit 24 may provide the ability to manually enter the person's weight in order for the pneumatic pump 19 to calculate the necessary pressure within the central telescoping unit 14 and the rate at which the central telescoping unit 14 fills with air. As air is pumped into the central telescoping unit 14, the seating member 16 will begin to rise once the psi within the interior 15 of the central telescoping unit 14 exceeds the weight of the person. This prevents the seat 10 from supplying less than the necessary amount of pressure to raise the person. Alternatively, a weight sensor 25 may be included within the seat 10 in order to determine the person's weight without having to manually input such information.

When the means 18 is a pneumatic pump, the seat 10 further comprises a first pressure relief valve 22 for automatically releasing pressure within the central telescoping unit 14 when the pressure therein becomes too great. Automatic pressure relief valves, such as low-pressure safety valves and vacuum pressure safety valves, which limit the pressure in a system and allow a pressurized fluid to flow out of a system, are well known and commercially available.

The first pressure relief valve 22 is in fluid communication with the central telescoping unit 14 via a second conduit 68. The second conduit 68 includes a first end 70 and a second end 72. The first end 70 of the second conduit 68 connects to the first pressure relief valve 22 and terminates within the interior 15 of the central telescoping unit 14 at the second end 72.

The first pressure relief valve 22 opens to allow air to exit the central telescoping unit 14, thus equalizing the pressure within the central telescoping unit 14 to a safe pressure and avoiding any rupturing within the seat 10. The first pressure relief valve 22 acts as a one-way check valve that opens when the pressure inside the central telescoping unit 14 exceeds a predetermined threshold and needs to be stabilized. Either the first pressure relief valve 22, itself, recognizes when the pressure exceeds the predetermined limit and opens or, alternatively, an air pressure sensor 23 may be employed to determine excessive pressure within the central telescoping unit 14. Where utilized, the air pressure sensor 23 is in operable communication, either mechanical or electrical, with the first pressure relief valve 22 in order to release air when necessary.

Preferably, the first pressure relief valve 22 is disposed within a second enclosure 28. The second enclosure 28 is mounted atop the platform 12 beside the central telescoping unit 14, opposite the first enclosure 26. The second enclosure 28 includes a pair of sidewalls 29*a*, 29*b*, a front wall (not shown), and a back wall 29*c* extending upwardly from the platform 12. A top wall 29*d* interconnects the pair of sidewalls 29*a*, 29*b*, front wall, and back wall 29*c* forming an enclosed interior 29*e* within the second enclosure 28. The second enclosure 28 further comprises a vent 50 formed in the sidewall 29*a* thereof for allowing air to escape the second enclosure 28.

Optionally, a second pressure relief valve 45 may be included to supplement the first pressure relief valve 22 and further release any air if the pressure within the central telescoping unit 14 is too great. Preferably, the second pressure relief valve 45 is disposed opposite the first pressure relief valve 22 and within the first enclosure 26. The second pressure relief valve 45 is in fluid communication with the central telescoping unit 14 via the first conduit 62. If the second pressure relief valve 45 is utilized, a vent (not shown) must be installed on a wall of the first enclosure 26 to allow for air to escape the first enclosure 26.

In use, the elevating seat 10 begins in the seated position as shown in FIG. 2. The person sitting atop the seating member 16 activates the power source 20 and the pneumatic pump 19 by pressing the "POWER" button on the control unit 24.

By pressing the "UP" button, the pneumatic pump 19 is activated in a first direction which elevates the seat 10 from a first position to a second position. In order to lift the seat 10, the pneumatic pump 19 draws in air through the inlet 30 and directs the air into the central telescoping unit 14 via the first conduit 62. Thus, air travels from the pneumatic pump 19, through the first conduit 62, and into the central telescoping unit 14. As the pressure builds within the central telescoping unit 14, the seat member 16 is urged upwardly and, with it, the plurality of frames 36, 36', 36", 36''' extend sequentially upwardly in the manner described in detail above.

As noted above, the first pressure relief valve 22 maintains a safe pressure within the central telescoping unit 14. When the pressure within the central telescoping unit 14 becomes too great, the first pressure relief valve 22 opens to allow air to exit the central telescoping unit 14 through the second conduit 68.

It is to be understood that the entire elevating seat 10 may be situated atop any seating 1 such as a chair, wheelchair, electric scooter, bench, bed, and the like, where the user desires to use the present invention therewith. The seat 10 may be a readily removed from the seating 1 by including means 74 for removably securing the seat 10 to the seating 1. The means 74 may include any suitable attachments such as a harness, buckle, clamps, and the like about the sides or platform 12 of the seat 10 and the seating 1 in which it is to be used with.

It is to be understood that those components described as being contained within the first or second enclosure 26, 28 are merely one embodiment of the present invention and a variety of configurations may be suitable to accomplish the same goal. They are not intended to be exhaustive or to limit the invention to the precise forms disclosed, and obviously many modifications and variations are possible in light of the above teaching. The foregoing descriptions of specific embodiments of the present invention have been presented merely for purposes of illustration and description.

LIST OF REFERENCE NUMBERS

1 Seating
10 Portable elevating seat
12 Platform
14 Central telescoping unit
15 Enclosed interior
16 Seating member
18 Means for raising and lowering
19 Pneumatic pump
20 Power source
22 First pressure relief valve
23 Air pressure sensor
24 Control unit
25 Weight sensor
26 First enclosure
27*a* Sidewall of first enclosure
27*b* Sidewall of first enclosure
27*c* Back wall of first enclosure
27*d* Top wall of first enclosure
27*e* Enclosed interior of the first enclosure
28 Second enclosure
29*a* Sidewall of second enclosure
29*b* Sidewall of second enclosure
29*c* Back wall of second enclosure
29*d* Top wall of second enclosure
29*e* Enclosed interior of the second enclosure
30 Inlet of pneumatic pump
32 Outlet of pneumatic pump
34 Seal of inlet
36, 36', 36", 36'" Frames
38, 38', 38", 38'" Upper end of frame
40, 40', 40", 40'" Lower end of frame
42, 42', 42", 42'" Lip
44, 44', 44", 44'" Lip surface
45 Second pressure relief valve
46, 46', 46", 46'" Ledge
48, 48', 48", 48'" Ledge surface
50 Vent
54 Second wire
56 Third conduit
58 Third wire
60 First wire
62 First conduit
64 First end of first conduit
66 Second end of first conduit
68 Second conduit
70 First end of second conduit
72 Second end of second conduit

Having thus described the invention, what is claimed is:

1. A portable elevating seat comprising:

(a) a platform;

(b) a central telescoping unit mounted atop the platform, the central telescoping unit including a seating member mounted thereon, the central telescoping unit having an enclosed interior provided between the platform and the seating member;

(c) means for raising and lowering the central telescoping unit, wherein the means for raising and lowering comprises a pneumatic pump in fluid communication with the central telescoping unit for injecting air into the interior of the central telescoping unit, the pneumatic pump having an inlet and an outlet;

(d) a power source in electronic communication with the means for raising and lowering;

(e) a control unit for actuating the central telescoping unit, the control unit being in electronic communication with the means for raising and lowering and the power source; and (f) a first enclosure including a plurality of walls defining an enclosed interior, the first enclosure being mounted atop the platform, the power source and the pneumatic pump being disposed with the enclosed interior of the first enclosure.

2. The portable elevating seat of claim 1 wherein the central telescoping unit comprises: a plurality of frames, each one of the plurality of frames having an upper end and a lower end, the lower end of an outermost frame of the plurality of frames being mounted atop the platform, the seating member being mounted atop the upper end of an innermost frame of the plurality of frames.

3. The portable elevating seat of claim 2 wherein each one of the plurality of frames is a nesting frame.

4. The portable elevating seat of claim 2 wherein each one of the plurality of frames is substantially rectangular.

5. The portable elevating seat of claim 3 wherein each one of the plurality of frames comprises:

(a) a ledge formed at the lower end thereof which extends outwardly from the enclosed interior of the central telescoping unit, the ledge including an upper ledge surface;

(b) a lip formed at the upper end thereof which extends inwardly toward the enclosed interior of the central telescoping unit, the lip including a lower lip surface; and wherein as each one of the plurality of frames translates vertically, the upper ledge surface of one of the plurality of frames engages the lower lip surface of an adjacent frame of the plurality of frames.

6. The portable elevating seat of claim 1, further comprising: a weight sensor for calculating the weight of a person sitting atop the seating member, the weight sensor determining an appropriate rate of supplying air into or drawing air out of the central telescoping unit based on the weight of the person.

7. The portable elevating seat of claim 1, further comprising:

a first conduit extending through the platform for placing the pneumatic pump in fluid communication with the central telescoping unit, the first conduit having a first end and a second end, the first end being secured to the outlet of the pneumatic pump, the second end terminating within the interior of the central telescoping unit.

8. The portable elevating seat of claim 1 wherein the control unit is disposed on the seating member.

9. The portable elevating seat of claim 1 wherein the first enclosure further comprises: a vent provided in one of the plurality of walls, the inlet of the pneumatic pump being secured to the vent to draw air from outside of the first enclosure.

10. The portable elevating seat of claim 1, further comprising:

(a) a first pressure relief valve; and (b) a second conduit extending through the platform for placing the first pressure relief valve in fluid communication with the central telescoping unit, the second conduit having a first end and a second end, the first end being secured to the first pressure relief valve, the second end terminating within the interior of the central telescoping unit.

11. The portable elevating seat of claim 10, further comprising:

an air pressure sensor being in operable communication with the first pressure relief valve, the air pressure sensor actuating the first pressure relief valve when the pressure within the central telescoping unit exceeds a predetermined threshold.

12. The portable elevating seat of claim 10, further comprising:

a second enclosure including a plurality of walls defining an enclosed interior, the second enclosure being mounted atop the platform, the first pressure relief valve being disposed with the enclosed interior of the second enclosure.

13. The portable elevating seat of claim 1 wherein the platform is positioned atop a seating.

14. The portable elevating seat of claim 13 further comprising: means for removably securing the portable elevating seat to the seating.

* * * * *